US007819061B2

(12) United States Patent
Geswender et al.

(10) Patent No.: US 7,819,061 B2
(45) Date of Patent: Oct. 26, 2010

(54) SMART FUZE GUIDANCE SYSTEM WITH REPLACEABLE FUZE MODULE

(75) Inventors: Chris E. Geswender, Green Valley, AZ (US); Stephen E. Bennett, Tucson, AZ (US); Matthew A. Zamora, Tucson, AZ (US); Cesar Sanchez, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 12/205,953

(22) Filed: Sep. 8, 2008

(65) Prior Publication Data

US 2010/0058946 A1 Mar. 11, 2010

(51) Int. Cl.
*F42C 13/04* (2006.01)

(52) U.S. Cl. ..... 102/206

(58) Field of Classification Search ..... 102/232, 102/206, 202.14, 202.12, 214
See application file for complete search history.

(56) References Cited

U.S. PATENT DOCUMENTS

| | | | | | |
|---|---|---|---|---|---|
| 2,849,956 | A * | 9/1958 | Johnson et al. | ..... | 102/276 |
| 3,027,842 | A * | 4/1962 | Hopkins | ..... | 102/214 |
| 3,143,072 | A * | 8/1964 | Dell et al. | ..... | 102/214 |
| 3,547,034 | A * | 12/1970 | Eneman et al. | ..... | 102/232 |
| 3,594,027 | A * | 7/1971 | Ressler et al. | ..... | 403/165 |
| 3,727,553 | A * | 4/1973 | Godfrey | ..... | 102/213 |
| 3,761,937 | A * | 9/1973 | Tricoles et al. | ..... | 343/770 |
| 3,839,963 | A * | 10/1974 | Nathan et al. | ..... | 102/214 |
| 4,949,917 | A * | 8/1990 | Cottle et al. | ..... | 244/3.16 |
| 4,962,706 | A * | 10/1990 | Ivermee et al. | ..... | 102/206 |
| 5,325,784 | A * | 7/1994 | Bai et al. | ..... | 102/293 |
| 6,094,054 | A * | 7/2000 | Crist | ..... | 324/452 |
| 6,098,547 | A * | 8/2000 | West | ..... | 102/214 |
| 6,892,646 | B1 * | 5/2005 | Zimmerman et al. | ..... | 102/293 |
| 7,057,567 | B2 * | 6/2006 | Koch | ..... | 343/708 |
| 7,121,210 | B2 * | 10/2006 | Steele | ..... | 102/211 |

FOREIGN PATENT DOCUMENTS

| | | | |
|---|---|---|---|
| DE | 29817728 | U1 | 2/1999 |
| EP | 1241435 | A1 | 9/2002 |

OTHER PUBLICATIONS

International Search Report and Written Opinion from corresponding International Application No. PCT/US09/52176.

* cited by examiner

*Primary Examiner*—Michael Carone
*Assistant Examiner*—Reginald Tillman, Jr.
(74) *Attorney, Agent, or Firm*—Renner, Otto, Boisselle & Sklar, LLP

(57) ABSTRACT

A smart fuze system includes a radome used to hold a replaceable smart fuze module in place. An internally-threaded collar screws onto threads on the main body of the smart fuze system. Pressure from the radome presses the smart fuze module against electrical connections in the main body. The smart fuze module may thereby be held in place without potting material, allowing different types of fuzes to be swapped into place. The different types of fuzes may include a type that communicates height of burst (HOB) information a type that communicates telemetry, and a type that communicates both HOB and telemetry information.

19 Claims, 2 Drawing Sheets

SMART FUZE GUIDANCE SYSTEM WITH REPLACEABLE FUZE MODULE

BACKGROUND OF THE INVENTION

1. Technical Field of the Invention

The invention is in the field of fuze systems for munitions.

2. Description of the Related Art

Smart fuzes have recently been used to provide better accuracy and effectiveness for munitions. It will be appreciated that improvements in systems utilizing smart fuzes would be desirable.

SUMMARY OF THE INVENTION

It has been found to be desirable to modify smart fuze systems to provide telemetry, such as for testing of rounds. In particular, a method and structure allows modification of smart fuze guidance systems in the field, without special training or tools, to replace a smart fuze module with a module having telemetry capability. Simply disassembly of the fuze nose, by unscrewing of a radome or a collar mechanically coupled to the radome, allows for replacement of a standard radio frequency (RF) height of burst (HOB) module with a module having telemetry capability. Using the radome to mechanically couple the fuze module within a recess in the primary fuze structure allows mechanical coupling without use of a potting material. Such potting materials have been used in the past, but make it difficult to swap out fuze modules for providing different capability, or for other purposes. By not utilizing the potting material or other bonding material, changes in fuze modules may be made quickly in the field without using tools.

In accordance with an aspect of the invention, a fuze module is mechanically coupled to a primary structure of a smart fuze module by pressure from a radome.

According to another aspect of the invention, a method of replacing a fuze module includes unscrewing a nose of a fuze guidance system, removing an old module, inserting a new module in a place where the old module was, and re-threading the nose in place.

According to still another aspect of the invention, a fuze module is held in place within a recess in a fuze guidance system, without use of potting material or other adhesive or bonding material. The fuze module includes an antenna and a circuit card assembly.

According to yet another aspect of the invention, a smart fuze system for a projectile includes: a primary fuze structure; a radome; and a replaceable fuze module. The fuze module has a connector interface for interfacing with electrical connections of the primary fuze structure. The radome has a bottom surface that presses against the fuze module, thereby mechanically coupling the fuze module in place with the connector interface against the electrical connections.

According to a further aspect of the invention, a method of modifying a smart fuze system includes the steps of: removing a radome that presses against a first smart fuze module against a primary fuze structure of the smart fuze system; replacing the first smart fuze module with a second smart fuze module; and replacing the radome, thereby pressing the second smart fuze module against the main body.

According to a still further aspect of the invention, a method of configuring a smart fuze system includes the steps of: selecting a smart fuze module from multiple different types of fuze modules; and installing the smart fuze in the smart fuze system, wherein the installing includes pressing a bottom surface of a radome of the smart fuze system against the smart fuze module.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A smart fuze system includes a radome used to hold a replaceable smart fuze module in place. An internally-threaded collar screws onto threads on the main body of the smart fuze system. Pressure from the radome presses the smart fuze module against electrical connections in the main body. The smart fuze module may thereby be held in place without potting material, allowing different types of fuzes to be swapped into place. The different types of fuzes may include a type that communicates height of burst (HOB) information a type that communicates telemetry, and a type that communicates both HOB and telemetry information.

Figure 1:
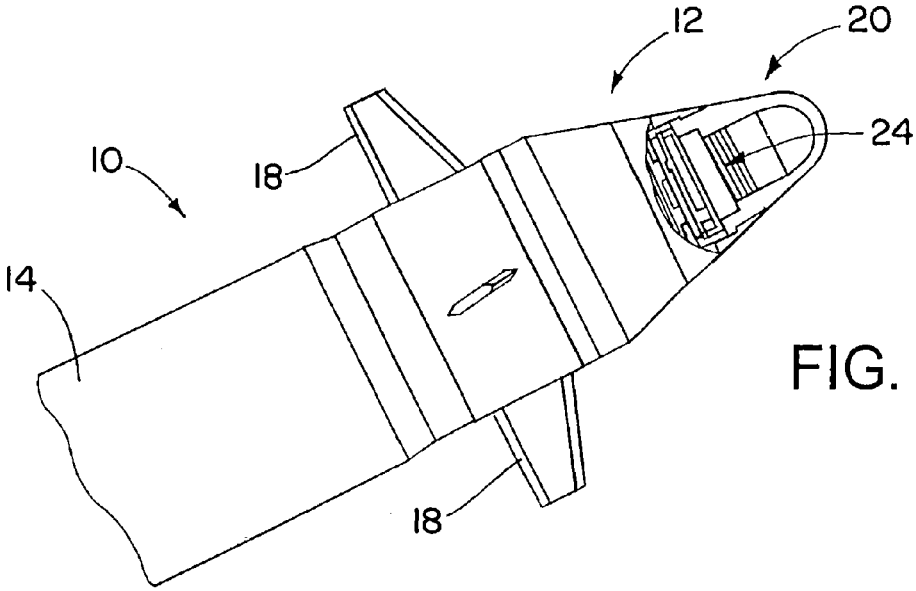
FIG. 1 is a cross-sectional view of a portion of a munition that uses a smart fuze guidance system in accordance with an embodiment of the present invention.
Figure 2:
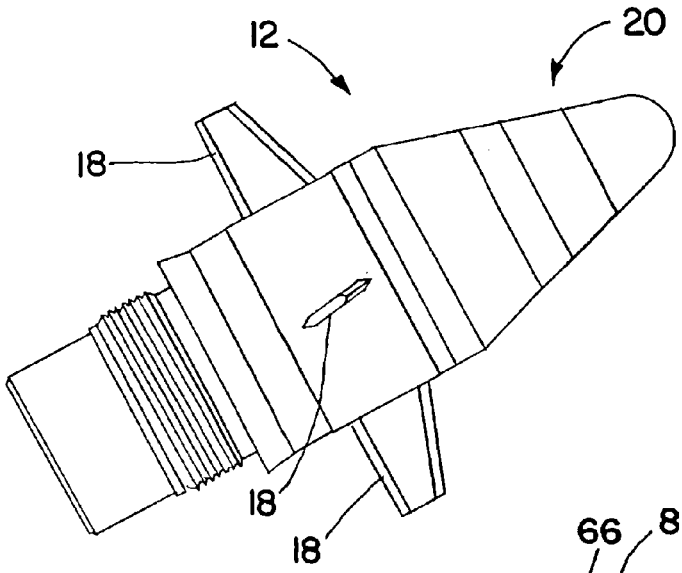
FIG. 2 is an oblique view of the fuze guidance system of FIG. 1.
Figure 3:
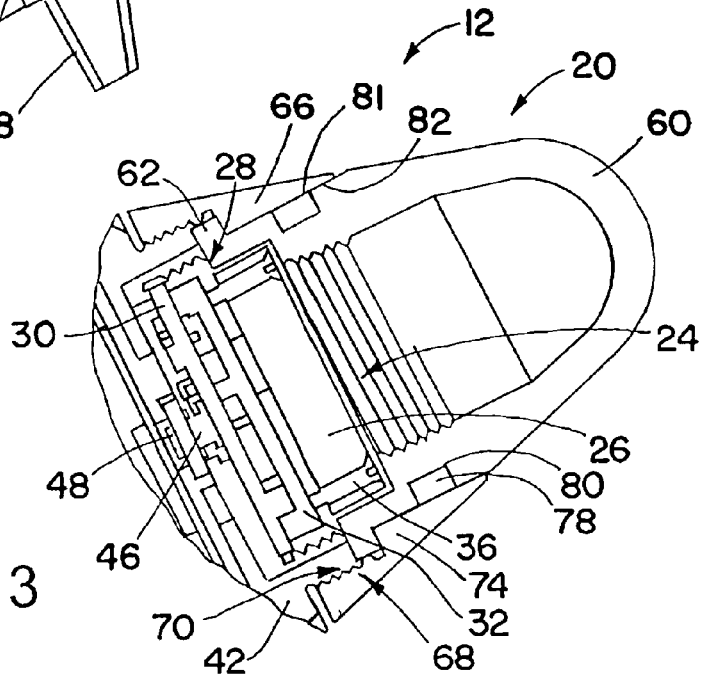
FIG. 3 is a cross-sectional view of a nose portion of the smart fuze guidance system of FIG. 1.

Referring initially to FIGS. 1-3, a munition 10 includes a smart fuze guidance system 12 coupled to a munition body 14. The smart fuze guidance system 12 provides a way of guiding the munition 10 toward a target, and detonating the munition 10 at or near the target. The fuze guidance system may involve a course correcting fuze (CCF), that allows for correction of the course of the munition 10 during flight. The smart fuze guidance system 12 has a series of canards 18 that may be used to control flight of the munition 10, through use of a suitable control system.

A nose portion 20 of the guidance system 12 includes a replaceable fuze module 24. The module 24 includes an antenna 26 and a circuit card assembly 28. The antenna 26 is used to communicate with devices external to the munition 10. The circuit card assembly 28 includes a logic card or circuit card 30 that handles communication through the antenna 26, and may also control other functions of the replaceable fuze. The circuit card assembly 28 also includes a digital logic portion 32.

The module 24 may be one of the series of types of modules that communicate different information and/or communicate using different modes. One type of fuze module 24 communicates or utilizes height of burst (HOB) information. Another type of fuze module communicates with external devices using telemetry (TM). A third type combines use of both telemetry and height of burst information.

The fuze module 24 is a smart fuze, in that its operation involves knowledge of where the munition 10 is, and where the intended target is. Such information may come from a global positioning system (GPS) or may come from external devices.

The height of burst (HOB) module is a proximity fuze that sends out signals, such as radio frequency (RF) signals to aid in determining proximity to intended target. The antenna 26 of such a smart fuze module may be used for sending and receiving the RF signals.

Telemetry (TM) in the fuze module 24 may be used to output information regarding flight of the munition 10 and information sensed by the smart fuze guidance system 12. Telemetry may be used for communicating values received in sensors, and information concerning trajectory states perceived by the smart fuze guidance system 12 and course corrections provided by the system 12.

The antenna 26 and the circuit card assembly 28 may be coupled together by any of a variety of suitable mechanisms, for example by use of threaded fasteners 36.

Figure 4:
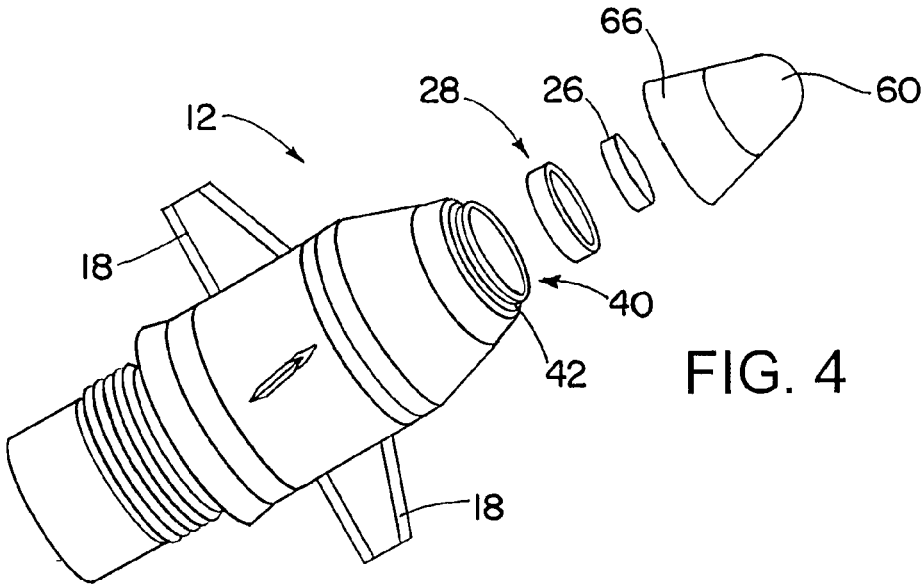
FIG. 4 is an exploded view of the smart fuze guidance system of FIG. 1.

With reference now in addition to FIG. 4, the module 24 is located in a recess 40 in a primary fuze structure 42. A connector interface 46 of the module 24 connects with mating electrical connections 48 of the primary fuze structure 42. The connection across the connector interface 46 and the electrical connections 48 may be used to provide power to the module 24, as well as to transfer data back and forth, to and from the module 24.

The smart fuze module 24 is held in place within the recess 40 by a radome 60 at the tip of the smart fuze guidance system 12. The radome 60 has a radome foot 62 which presses against the circuit card assembly 28. A collar 66 is used to press the radome 60 down against the circuit card assembly 28. The collar 66 has a threaded inner surface 68 that engages corresponding threads 70 on an end of the primary fuze structure 42. The threads 68 and 70 may be a self-tightening thread connection, for example having a counter clockwise threading direction for a munition that turns in a clockwise direction during launch.

The radome 60 and the collar 66 have a substantially continuous outer surface, with substantially no discontinuity of shape between the two where they meet. The collar 66 has a tapered shape that engages the tapered shape of the radome 60 where the two meet. The collar 66 has an annular wedge shape. The collar 66 has an inward step 74 that presses against the radome foot or lip 62 as the collar 66 is threaded onto the primary fuze structure 42.

The radome 60 may be made of a composite material, or of another suitable material. The collar 66 may be made of steel or another suitable metal or non-metal material. An O-ring 78 may be used to seal the joint between the radome 60 and the collar 66. The O-ring 78 may rest in an O-ring recess 80 in an outer surface 82 of the radome 60 that is surrounded by an inner surface 81 of the collar 66.

The module 24 is advantageously retained in the recess 40 without the use of any potting material or other adhesive. Thus the module 24 may be easily removed from the recess 40 and replaced with another module. This may be accomplished simply by unscrewing the steel collar 66, lifting off the radome 60, and removing the fuze module 24 from engagement with the electrical connections 48. A different module, perhaps having different functionality, may be easily substituted into the recess 40. This allows flexibility in configuring the smart fuze guidance system 12. Modules utilizing telemetry may be easily swapped out with other types of modules, for example being used to perform debugging of systems, or to otherwise gather information about system performance. The use of replaceable fuze modules allows flexibility in usage, and obviates the need to stock a variety of different fuze guidance systems capable of performing different functions. In addition, the replacability allows users to use native designed and manufactured HOB RF fuzes or telemetry units, providing increased security.

Figure 5:
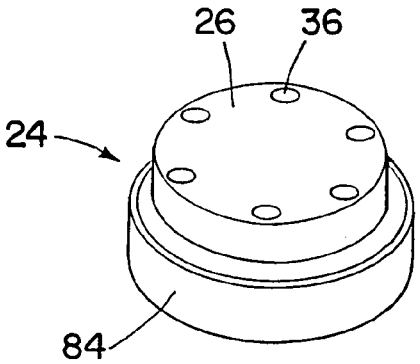
FIG. 5 is an oblique view showing the top surfaces of a fuze module of the smart fuze guidance system of FIG. 1.
Figure 6:
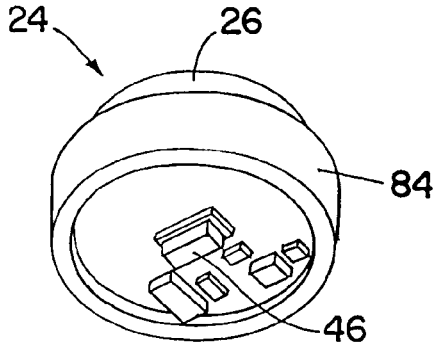
FIG. 6 is an oblique view showing bottom surfaces of the fuze module of FIG. 5.

FIGS. 5 and 6 show additional views of the fuze module 24. The fuze module 24 shown in FIGS. 5 and 6 may be any of a variety of above-described types of fuze modules having different functionality. Since modules having different functionality do not have any large-scale structural differences, it has not been thought necessary to show separate figures of different types of fuze modules. The fuze module 24 includes the antenna 26 and the circuit card assembly 28. As described above, the circuit card assembly 28 includes the logic card 30 with the connector interface 46. The circuit card assembly may also include suitable structure 84 for holding together its various components. The structure 84 may be an annular plastic part that couples together the logic card or circuit card 30 and the digital logical portion 32 (FIG. 3).

The guidance system 12 advantageously avoids use of potting materials to hold the fuze module 24 in place. This allows for easy removal and/or replacement of fuze modules.

Figure 7:
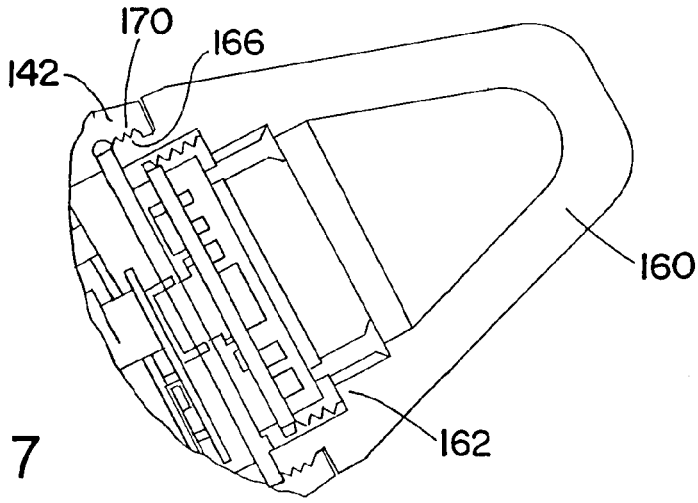
FIG. 7 is a cross-sectional view of a nose portion of an alternate embodiment smart fuze guidance system in accordance with the present invention.

FIG. 7 shows an alternate embodiment smart fuze guidance system 112 that has a radome 160 that substitutes for the separate radome 60 and collar 66 (FIG. 3). The radome 160 has an inner step 162 that is used to press against a circuit card assembly 28 of a fuze module 24. The fuze module 24 and its engagement with a primary fuze structure 142 may be substantially the same as that described above with regard to the first embodiment. The radome 160 has an outer thread 166 that engages corresponding threads 170 on an inside surface of the primary fuze structure 142. The radome 160 may be made completely of composite material or another suitable material. Alternatively, the radome 60 may have an insert, such as a steel insert, that provides the threads 166. It will be appreciated that features described above with regard to the individual fuze guidance systems 12 and 112 may be combinable, where suitable.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A smart fuze system for a projectile, the system comprising:

a primary fuze structure;

a radome; and a replaceable fuze module;

wherein the fuze module has a connector interface interfacing with electrical connections of the primary fuze structure; and wherein the radome has a bottom surface that presses against the fuze module, thereby mechanically coupling the fuze module in place with the connector interface against the electrical connections.

2. The system of claim 1, wherein the replaceable fuze module is held in place only by pressure applied by the bottom surface of the radome.

3. The system of claim 1, further comprising a collar surrounding the radome;

wherein the collar has internal threads that engage corresponding threads on the primary fuze structure to press the radome against the fuze module.

4. The system of claim 3, wherein the radome and the collar are integrated as a single piece.

5. The system of claim 3, wherein the collar is a steel collar.

6. The system of claim 3, further comprising a seal between the radome and the collar.

7. The system of claim 3, wherein the internal threads and the corresponding threads form a self-tightening threaded connection.

8. The system of claim 1, wherein the fuze module provides height of burst (HOB) information.

9. The system of claim 1, wherein the fuze module provides telemetry (TM) information.

10. The system of claim 1, wherein the fuze module provides both height of burst (HOB) information and telemetry (TM) information.

11. The system of claim 1, wherein the fuze module is held in place without use of potting material.

12. A method of modifying a smart fuze system, the method comprising:

removing a radome that presses a first smart fuze module against a primary fuze structure of the smart fuze system;

replacing the first smart fuze module with a second smart fuze module; and replacing the radome, thereby pressing the second smart fuze module against the primary fuze structure.

13. The method of claim 12, wherein the fuze modules are of different types, wherein the types include a first type that provides (HOB) information, and a second type that provides telemetry (TM) information.

14. The method of claim 12, wherein the removing includes unscrewing a collar that is initially threaded onto the primary fuze structure, wherein the collar presses the radome against the first smart fuze module prior to the unscrewing.

15. The method of claim 14, wherein the unscrewing includes unscrewing a self-tightening threaded connection that self-tightens during launch of a munition on which the smart fuze system is mounted.

16. A method of configuring a smart fuze system, the method comprising:

selecting a smart fuze module from multiple different types of fuze modules; and installing the smart fuze in the smart fuze system, wherein the installing includes pressing a bottom surface of a radome of the smart fuze system against the smart fuze module.

17. The method of claim 16, wherein the different type of fuze modules include a first type that provides (HOB) information, and a second type that provides telemetry (TM) information.

18. The method of claim 16, wherein the pressing includes screwing a collar onto threads on the primary fuze structure, wherein the collar presses the radome against the smart fuze module.

19. The method of claim 18, wherein the screwing includes making a self-tightening threaded connection that self-tightens during launch of a munition on which the smart fuze system is mounted.

* * * * *